United States Patent [19]

Lehmann

[11] Patent Number: 4,872,568

[45] Date of Patent: Oct. 10, 1989

[54] COAT HANGER SUSPENDING DEVICE

[76] Inventor: Ernest Lehmann, P.O. Box 1, Bellport, N.Y. 11713

[21] Appl. No.: 231,589

[22] Filed: Aug. 8, 1988

Related U.S. Application Data

[63] Continuation-in-part of Ser. No. 33,019, Mar. 31, 1987, abandoned.

[51] Int. Cl.[4] ..... A47G 25/02

[52] U.S. Cl. ..... 211/113; 223/85

[58] Field of Search ..... 223/85, DIG. 4; 211/113; 224/42.45 A, 42.46 A; 248/340

[56] References Cited

U.S. PATENT DOCUMENTS

| | | | |
|---|---|---|---|
| D. 184,686 | 3/1959 | Rosene | 211/113 X |
| D. 190,608 | 6/1961 | Forrester | 223/85 X |
| D. 193,919 | 10/1962 | Meyer et al. | 211/113 X |
| 285,159 | 9/1883 | Reynolds . | |
| 1,172,937 | 2/1916 | Butcher | 211/113 |
| 1,966,283 | 7/1934 | Brody . | |
| 2,480,327 | 8/1949 | Idelsohn . | |
| 2,604,999 | 7/1952 | Sutton . | |
| 2,609,104 | 9/1952 | Leach | 211/113 X |
| 2,699,263 | 1/1955 | Ore . | |
| 2,714,965 | 8/1955 | Fitzkee et al. . | |
| 3,002,666 | 10/1961 | Silverman | 224/42.45 A |
| 3,085,691 | 4/1963 | Smith . | |
| 3,270,892 | 9/1966 | Dennis et al. | 211/113 |
| 3,907,118 | 9/1975 | Pelavin | 211/113 |
| 4,073,458 | 2/1978 | Sease | 248/340 |

FOREIGN PATENT DOCUMENTS

| | | | |
|---|---|---|---|
| 2916906 | 11/1980 | Fed. Rep. of Germany | 211/113 |
| 3335939 | 4/1985 | Fed. Rep. of Germany | 223/85 |
| 526198 | 5/1955 | Italy | 223/85 |
| 87536 | 4/1956 | Norway | 211/113 |
| 570311 | 7/1945 | United Kingdom | 223/85 |

*Primary Examiner*—Robert R. Mackey
*Attorney, Agent, or Firm*—Kelly & Hulme

[57] ABSTRACT

A device is provided which may be used to suspend coat hangers or the like in order to expand the storage capacity of a closet, garment bag or other like clothing storage units. The device is comprised of a unitary elongated rod member having a generally channel-shaped cross section and which defines a plurality of coat hanger engaging openings, preferably oblong in shape, along its length. In addition, the elongated rod member is provided with at least one rigid open hook member, such that the device of the present invention may be suspended from a suitable supporting means such as a closet pole, wall hook, or the like.

4 Claims, 1 Drawing Sheet

COAT HANGER SUSPENDING DEVICE

This application is a continuation-in-part of application Ser. No. 33,019, filed 3/31/87, now abandoned.

This present invention relates to a device from which coat hangers and the like may be suspended. More particularly this invention relates to a device which provides means for suspending a plurality of coat hangers within a closet, garment bag or the like.

BACKGROUND OF THE INVENTION

In a typical household closet, a rod or pole is provided from which coat or clothing hangers may be suspended and maintained. However, when the space on the rod is full, no more hangers may be suspended from the rod. Furthermore, closet space above or blow the articles so hung is not utilized and to get additional space some articles within the closet must be removed or alternate storage areas must be found.

A similar situation is found in the garment bag typically used by travelers to carry clothing and the like while on a trip. A hook or loop is provided within the bag from which coat hangers may be suspended. However, the hook loop is usually very small and may only allow for a small number of hangers to be suspended therefrom thereby limiting the capacity of the garment bag.

In addition, it is sometimes the case that temporary provisions for hanging coat hangers and the like is desired but that the time the support is needed is short or the space in which it is needed does not lend itself to the more typical types of coat hanger suspending arrangements (e.g., wooden rods with supports at both ends).

Furthermore, as is well known coat hangers are provided in many shapes and sizes and in addition the hook end of said hanger may have a loop on its end of a larger cross section than the hanger itself and/or other type of arrangement. It is therefore necessary to have a hanger suspending device which is capable of receiving the hook end of various types of coat hangers.

It is therefore an object of the present invention to provide a coat hanger suspending device which will expand the useable space of household closets and/or garment bags.

It is another object of the present invention to provide coat hanger suspending capability which may be used temporarily or in small spaces.

It is yet another object of the present invention to provide a coat hanger suspending device in which the hangers may be easily and efficiently removed or replaced which arrangement will facilitate the storage of garments and other clothing in a neat fashion.

It is still another object of the present invention to provide a coat hanger suspending device in which hangers having various hook arrangements and cross sections may be easily and efficiently removed and/or replaced.

Additional objects and advantages of the present invention will become apparent for the following description and claims in combination with the drawings.

SUMMARY OF THE INVENTION

The objects of the present invention are accomplished by a device comprised of an elongated unitary member having a channel-shaped cross section which defines a plurality of openings along its length; at least one rigid open hook member freely and flexibly connected to one end of said elongated rod member. However, in a preferred embodiment of the present invention, said elongated member has a first rigid open hook member attached to one end and a second rigid open hook member attached to the opposite end of the elongated member. In addition, the openings defined in said elongated member are most advantageously employed when they are oblong in shape.

The device of the present invention is used by engaging some type of support means such as a horizontal closet pole or hooks fastened to a wall, with one or both of the hooks provided in the present invention. The openings provided in the device may then be used to receive and engage the hook end of a conventional wire clothing hanger.

When only one of the hooks of the present invention is used to suspend the present invention, the device is disposed in a generally vertical position whereby the area below the means of suspension may be utilized for hanging or suspending articles of clothing or otherwise. If both hooks are used to suspend the present invention, it will be disposed in a direction which is generally horizontal and parallel to the means of suspension. In that way articles or the like which are to be suspended in such a direction may be achieved.

DETAILED DESCRIPTION OF THE INVENTION

Figure 1:
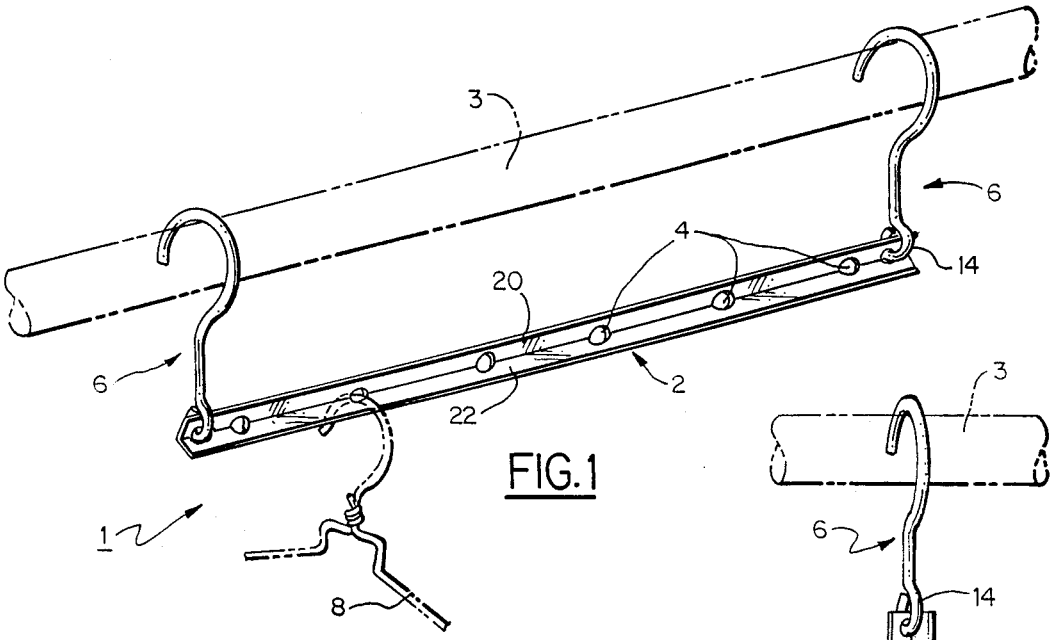
FIG. 1 is a perspective view of the coat hanger suspending device of the present invention.

Referring specifically to the drawings, FIG. 1 shows a coat hanger suspending device 1 which may be suspended from a pole 3 typically found in a household closet. The device is comprised of a unitary (i.e., formed from one piece) elongated member 2 and at least one rigid open hook member 6 which is used to suspend the device 1 from closet pole 3.

The elongated member 2 used in the present invention is comprised of a unitary elongated rod, unitary in that it is formed from one piece of material. In addition the elongated member 2 has a channel-shaped cross section such that a first side edge 20 and a second side edge 22 come together to form an angle which in the preferred embodiment is approximately ninety (90) degrees. As a result of this arrangement, the device of the present invention has a much greater strength as compared to a flat elongated member of the same dimensions. Therefore, the device of the present invention can be made in relatively small sizes and still support great amounts of weight. In addition, the elongated member 2 defines a plurality of openings 4 therethrough, the openings being spaced along the length of the elongated member 2. The holes 4 are sized so as to adequately receive and allow for the removal of the hook end of the conventional wire clothing hanger 8 although these holes 4 may be larger or smaller depending on the size of the hook end which is to be engaged thereby. In addition, the holes 4 may be spaced uniformly, randomly, or in any desirable pattern along the length of the elongated member 2.

Finally, the openings 4 defined in elongated member 2 are preferably oblong in shape. In this way the hanger suspending device 1 of the present invention may be advantageously employed with coat hangers having hooks thereon of various cross sections. In other words, openings are provided in elongated member 2 which due to their shape may receive these various cross sections but also because of the shape do not weaken the device or require that the device be as large as it would have to be to provide adequate support if the holes were spherical and be large enough to receive some of the larger coat hangers.

As described above, a rigid open hook member 6 is attached to each end of elongated member 2 so that the elongated member 2 may be suspended in the area in which it is to be used. Each hook member 6 is comprised of a straight portion 7 and a hook portion 9 and is so shaped as to form an opening 11 through which the pole or other means of support from which the device 1 of the present invention will be suspended may be received. The opening 11 is sized so that the hook may freely engage and be removed for supporting means of various sizes and shapes. The length of the straight portion 7 of each hook member 6 will determine how far and at what angle below the closet pole 3 the device 1 of the present invention will be maintained. This length may be different from that depicted in the drawings without going beyond the scope of the present invention.

Finally, the rigid nature of the hook members 6 provides for the maintenance of the dimensional relationship between the device of the present invention and the support means from which it is suspended.

Hook member 6 is connected to the elongated member 2 in such a way as to provide a free, flexible connection therebetween. As is depicted in the drawings, this may be accomplished by providing a loop 14 at the free end of the straight hook portion 9, said loop engaging one of the plurality of the holes defined by elongated member 2. While in the drawings the hooks 6 are connected to the holes 4 closer to first and second ends of the elongated member 2, it will be clear to one skilled in the art that this need not be the case and that one or more hook members 6 may be connected to elongated member 2 through any hole defined by the elongated member depending on the application to which the device of the present invention is to be put.

Figure 2:
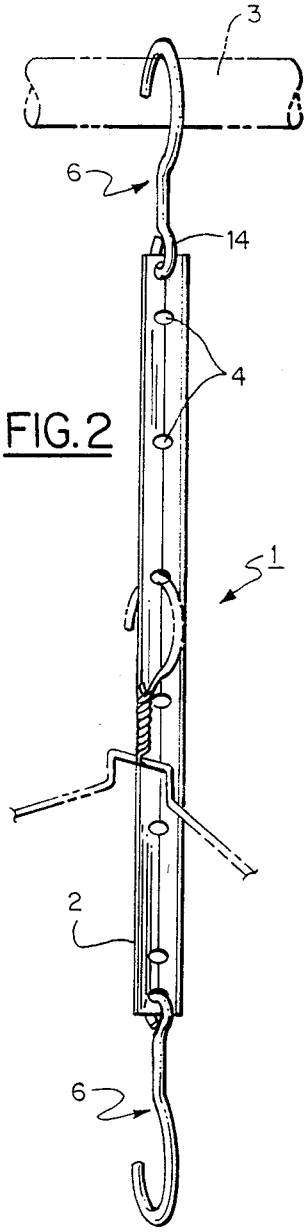
FIG. 2 is a perspective view of the device of FIG. 1 showing an alternative suspending arrangement for the device.
Figure 3:
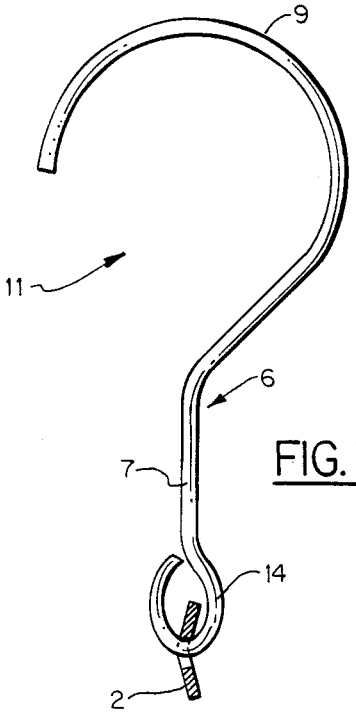
FIG. 3 is a view of one of the open hook members which forms a part of the present invention.

Finally, as shown by the comparison of FIGS. 1 and 2, the device 1 of the present invention may be suspended from a closet pole 3 (or the like) by one or more hook members. If two or more hook members 6 are used, the device 1 will be suspended in a direction which is generally parallel to the closet pole (although the exact relationship will be determined by the relative length of the straight portion 7 of each hook member 6). Conversely, if only one hook member 6 engages the suspending system, the device 1 of the present invention will be suspended in a direction which is generally perpendicular to the supporting system.

Furthermore, adequate and useful results may be had with the present invention when it is used in combination with supporting systems other than the above described closet pole such as hooks fixed to walls between which the device 1 is to be suspended or by using support wires dropped from above the desired location of the device 1 when the device 1 is to be used to support coat hangers. In addition, the device 1 may be used in garment bags, luggage or other clothing carrying bags to expand the carrying capacity of these bags.

The device 1 of the present invention may be formed from any material having suitable strength to hold the clothing and the like which is to be suspended therefrom. These materials include but are not limited to cold-rolled steel, aluminum, rigid plastics and the like.

It will be clear to one skilled in the art that, although the description of the present invention has been made relative to the use of coat hangers, the present invention has other applications which include but are not limited to hanging or displaying items which are capable of suspension by a hook of some type. As a result, the device 1 of the present invention may be adequately and beneficially used in kitchens, workshops, store displays and the like.

What I claim is:

1. A coat hanger supporting device comprising:

an elongated unitary rod member having a uniform, generally channel-shaped cross section consisting of two sides forming on angle therebetween and further having a first end and a second end, said rod member defining a plurality of oblong openings therethrough in the area where the two sides come together to form the angle, said openings being spaced along the length thereof;

a first rigid open hook member freely and flexibly connected to said first end of said rod member, such that a universal swivel between said first hook and said rod member is formed;

a second rigid open hook member freely and flexibly connected to said rod member, such that a universal swivel is formed therebetween, and first and second hook member being sized and shaped to facilitate attachment and removal of the device from supporting means of various shapes and sizes to which at least one of said first or second hook members may be so engaged, said universal swivel providing a free and flexible connection such that said hook members may form a full range of angles relative to said rod member in any direction when said hook is attached to said supporting means.

2. The device of claim 1 wherein each said open hook member is comprised of a generally straight portion and a hook portion joined to said straight portion, said hook and straight portions forming an opening therebetween through which said supporting means may pass to be engaged by said open hook member.

3. The coat hanger device of claim 1 wherein the channel-shaped cross section forms an angle of ninety (90) degrees.

4. The coat hanger device of claim 1 wherein each said rigid hook member defines a closed loop which loop passes through and engages one of said openings defined in said rod member such that said universal swivel is formed between said rod and said hook member.

* * * * *